United States Patent [19]

Abe et al.

[11] 4,302,247

[45] Nov. 24, 1981

[54] HIGH STRENGTH AUSTENITIC STAINLESS STEEL HAVING GOOD CORROSION RESISTANCE

[75] Inventors: Ryouichi Abe, Akashi; Masao Sato, Minoo; Seiji Kikuma, Kobe, all of Japan

[73] Assignee: Kobe Steel, Ltd., Kobe, Japan

[21] Appl. No.: 114,387

[22] Filed: Jan. 22, 1980

[30] Foreign Application Priority Data

Jan. 23, 1979 [JP] Japan ..... 54-6681

[51] Int. Cl.[3] ..... C22C 30/00; C22C 38/44

[52] U.S. Cl. ..... 75/122; 75/128 A; 75/128 N; 75/128 W; 75/128 V; 75/134 F; 148/38

[58] Field of Search ..... 75/128 A, 128 N, 128 W, 75/128 V, 122, 134 F; 148/38

[56] References Cited

U.S. PATENT DOCUMENTS

| | | | |
|---|---|---|---|
| Re. 28,772 | 4/1976 | Denhard et al. | 75/128 A |
| 3,592,634 | 7/1971 | Denhard et al. | 75/128 A |
| 3,660,080 | 5/1972 | Espy et al. | 75/128 A |
| 3,726,668 | 4/1973 | Baumel | 75/125 |
| 4,060,389 | 11/1977 | Nishimura et al. | 75/128 N |
| 4,078,920 | 3/1978 | Liljas et al. | 75/128 A |

OTHER PUBLICATIONS

Perry's Chemical Engineers' Handbook, 4th Edition, pp. 23-48.

*Primary Examiner*—R. Dean

*Attorney, Agent, or Firm*—Oblon, Fisher, Spivak, McClelland & Maier

[57] ABSTRACT

The present invention discloses a high strength austenitic stainless steel having good corrosion resistance and, in particular, good hydrogen embrittlement resistance, which consists essentially of up to 0.02% by weight of C, up to 0.7% by weight of Si, 2.0 to 6.5% by weight of Mn, 17.5 to 30.0% by weight of Ni, 23.0 to 35.0% by weight of Cr, 1.5 to 5.5% by weight of Mo, 0.15 to 0.45% by weight of N, 0 to 0.6% by weight of V, the balance iron and inevitable impurities.

6 Claims, 9 Drawing Figures

HIGH STRENGTH AUSTENITIC STAINLESS STEEL HAVING GOOD CORROSION RESISTANCE

BACKGROUND OF THE INVENTION

1. Field of the Invention

This invention relates to a high strength austenitic stainless steel having excellent corrosion resistance and, in particular, hydrogen embrittlement resistance in various corrosive environments.

2. Description of the Prior Art

Recently, there is a growing tendency to use high temperatures and high pressures in the chemical production processes for increasing the production efficiency. In order to go with such trend of the industry, demand is growing for stainless steel having enough corrosion resistance and strength to stand use under such high-temperature and high-pressure conditions. It has been attempted to improve corrosion resistance of austenitic stainless steel by adding Cr while precipitation of carbonitrides or intermetallic compounds has been resorted to for the improvement of strength, so that such conventional austenitic stainless steels are still unsatisfactory in corrosion resistance. Although steel strength can be increased by means of work hardening, this method involves the problems of drop of strength at high temperatures and stress corrosion cracking. There is also available a steel material such as ASTM A 269 XM-19 which is added with Mo for the improvement of corrosion resistance and Mn, N, etc., for the improvement of strength, however even such high strength austenitic stainless steel with relatively good corrosion resistance fails to remedy the problem of hydrogen embrittlement in use under the high-temperature and/or high-pressure conditions.

Thus, many attempts have been made for the improvements of stainless steel, but any of the known steel products has its own merits and demerits and there is yet available no steel which meets all the requirements to a satisfactory degree. It is therefore strongly requested in the industry to develop a new steel material which can maintain high strength as well as good corrosion resistance and, in particular, hydrogen embrittlement resistance under the strict high-temperature and high-pressure use conditions.

This invention has been deviced with the object of answering to such request. The present inventors took note of the fact that deterioration of corrosion resistance of conventional austenitic stainless steel has close relation to the presence of a heterogeneous phase (such as ferrite phase) in the steel structure and investigated the relationship between strength and corrosion resistance in the state of solid solution. It was found as a result that a steel material capable of maintaining high strength under high temperatures can be obtained by increasing the effective Cr content while also incorporating Mo and N in proper quantities in the extra low carbon steel base, and that addition of a proper amount of Ni to such extra low carbon steel can produce a prominent improving effect in resistance to pitting corrosion, crevice corrosion, intergranular corrosion, stress corrosion cracking and, in particular, hydrogen embrittlement. It was also found that steel strength can be further enhanced without affecting said corrosion resistance by adding a suitable quantity of V in addition to Mn, N and Mo.

SUMMARY OF THE INVENTION

As understood from the above, the present invention has been deviced with the object of surmounting the technical problems that attend the conventional austenitic stainless steels, and an object of this invention is to provide a high strength austenitic stainless steel which has good corrosion resistance and, in particular, excellent hydrogen embrittlement resistance under the various corrosive environments. It is also an object of this invention to provide an austenitic stainless steel which maintains excellent corrosion resistance (particularly hydrogen embrittlement resistance) as well as high strength even under the severe high-temperature and high-pressure use conditions.

In order to accomplish the said objects, this invention provides, in an aspect thereof, a high strength austenitic stainless steel having good corrosion resistance and, in particular, good hydrogen embrittlement resistance, which consists essentially of (% by weight):

| | |
|---|---|
| C: | up to 0.02 |
| Si: | up to 0.7 |
| Mn: | 2.0 to 6.5 |
| Ni: | 17.5 to 30.0 |
| Cr: | 23.0 to 35.0 |
| Mo: | 1.5 to 5.5 |
| N: | 0.15 to 0.45 |
| V: | 0 to 0.6 |

the balance being iron and inevitable impurities.

Further aspects of the invention will become apparent from the following description of the invention.

DETAILED DESCRIPTION OF THE PREFERRED EMBODIMENTS

The steel of this invention is now described in detail concerning its composition in particular.

Figure 1:
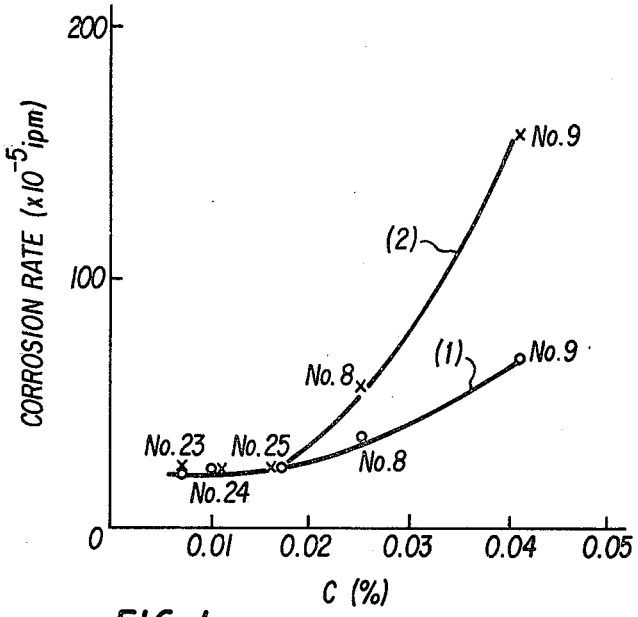
FIG. 1 is a graph showing the relation between corrosion rate and C content in austenitic stainless steel.

C is usually bonded with Cr to form a carbide to reduce the effective Cr content for corrosion resistance, so that usually the smaller the C content, the better for preventing deterioration of corrosion resistance. FIG. 1 is a graph showing the "relation between C content (%) and corrosion rate (ich per month (ipm)) as determined from a "Huey test" (each test specimen is immersed in 65% nitric acid (boiled) for 48 hours, and such immersion is repeated five times) conducted on the test specimens with different C contents (basic composition:

0.5% Si, 2.5% Mn, 19% Ni, 25% Cr, 30% Mo, 0.25% N and various % C). In the graph, curve (1) represents the results obtained from the solution heat treated steel specimens and curve (2) represents the results obtained from the sensitized steel specimens. As shown in the graph, the corrosion rate rises as the C content increases, and although this tendency is conspicuous particularly in the sensitized specimens, there is noted a steady increase in the degree of deterioration of corrosion resistance even in the solution heat treated specimens. If the C content is kept below 0.03%, the corrosion rate is limited to a passable degree, and if said content is up to 0.02%, there is induced almost no effect of the sensitization treatment. Hence, the C content in the steel composition of this invention is defined to be 0.02% or less.

Figure 2:
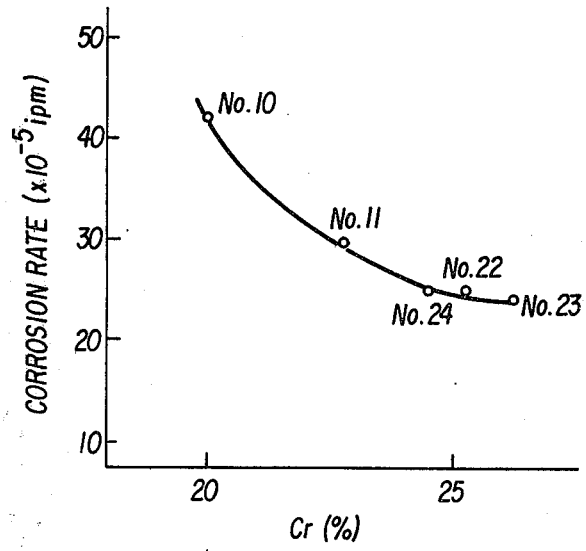
FIG. 2 is a graph showing the relation between Cr content and corrosion rate.

Cr is a key element for giving corrosion resistance to stainless steel. FIG. 2 is a graph showing the relation between Cr content and corrosion rate as determined from a "Huey test" conducted on the test specimens with various Cr contents (basic composition: 0.01% C, 0.5% Si, 2.5% Mn, 19% Ni, 0.25% N, 3% Mo and various % Cr). It will be seen from the same graph that corrosion resistance is improved with increase of the Cr content, and a marked reduction of corrosion rate is provided by addition of not less than 23.0%, particularly not less than 24.0% of Cr. However, too much amount of Cr makes it hard to control the $\delta$ ferrite phase in the steel structure to encourage precipitation of the $\sigma$ phase, resulting in a heterogenous phase formation in the structure to adversely affect corrosion resistance as well as workability of the steel. For averting such ill effects, it is desirable to set the upper threshold value of Cr content at 35.0%. Also, when Cr is added in a large amount, it is required to correspondingly increase the Ni content for keeping the austenite structure, and this may lead to an increased production cost, so that the upper limit of the Cr content should preferably be set at 27.0%. Thus, the Cr content in the steel composition of this invention is defined within the range of 23.0–35.0%, preferably 24.0–27.0%.

Figure 3:
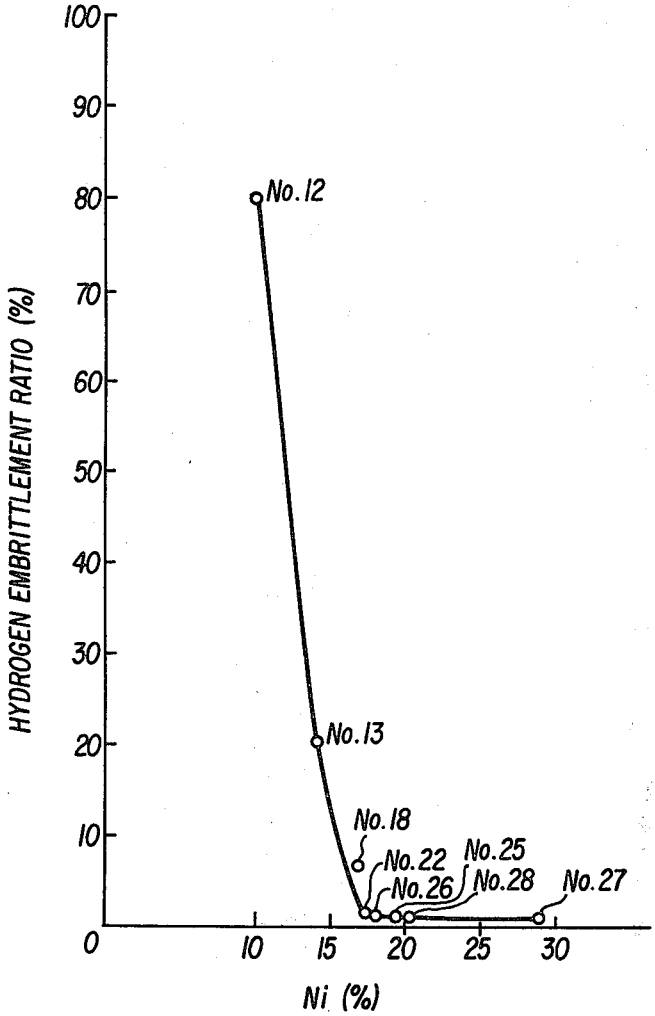
FIG. 3 is a graph showing the relation between Ni content and hydrogen embrittlement ratio.

Ni not only has the effect of improving corrosion resistance against nitric acid and other various kinds of non-oxidizing acids but is also effective in stabilizing the austenite structure and preventing stress corrosion cracking as well as hydrogen embrittlement. FIG. 3 is a graph showing the relation between hydrogen embrittlement ratio and Ni content as obtained from a test of the steel samples with different Ni contents (basic composition: 0.01% C, 0.5% Si, 2.5% Mn, 25% Cr, 3% Mo, 0.25% N and various % Ni) under the conditions of 450° C. and 300 atm partial pressure of hydrogen. The hydrogen embrittlement ratio (%) was expressed by way of the percentage of the difference between elongation before hydrogen charging ($l_O$) and elongation after hydrogen charging ($l_H$) divided by the former, that is, $(l_O-l_H)/l_O\times 100\%$. As seen from the graph, the hydrogen embrittlement ratio decreases as the Ni content increases, but the decrease of said ratio becomes almost null when the Ni content reaches 17.5%. Thus, as apparent from FIG. 3, hydrogen embrittlement may be caused when the NI content is less than 17.5%, while too much Ni content result in a saturated effect and rather causes an economical loss. In view of these facts and also by taking into account the joint effect of N and Mn which are also the essential austenite forming component elements, the Ni content is defined to be 17.5–30.0%. It is to be noted that high Ni content causes a reduction of strength, so that where particularly high steel strength is required, it is recommended to define the upper limit of the Ni content at around 23.0%.

Figure 5:
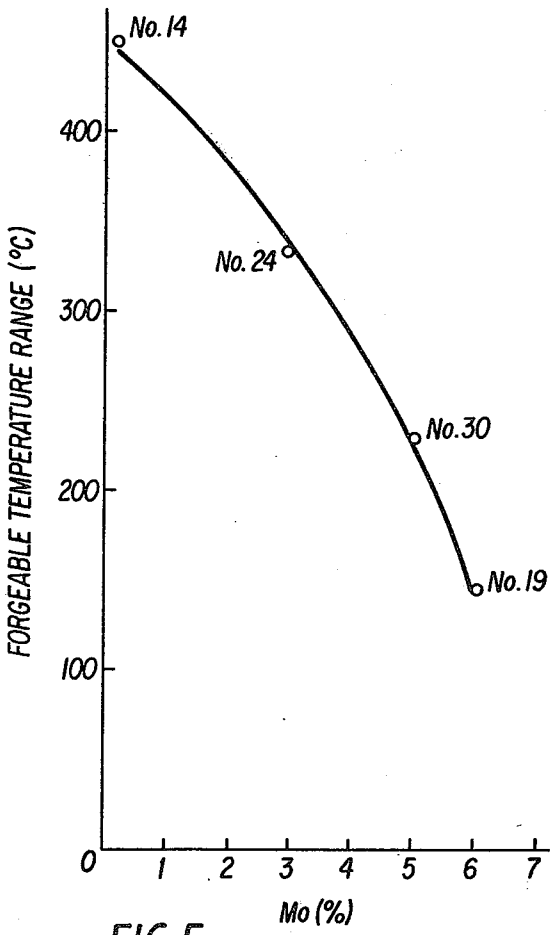
FIG. 5 is a graph showing the relation between Mo content and forgeable temperature range.
Figure 4:
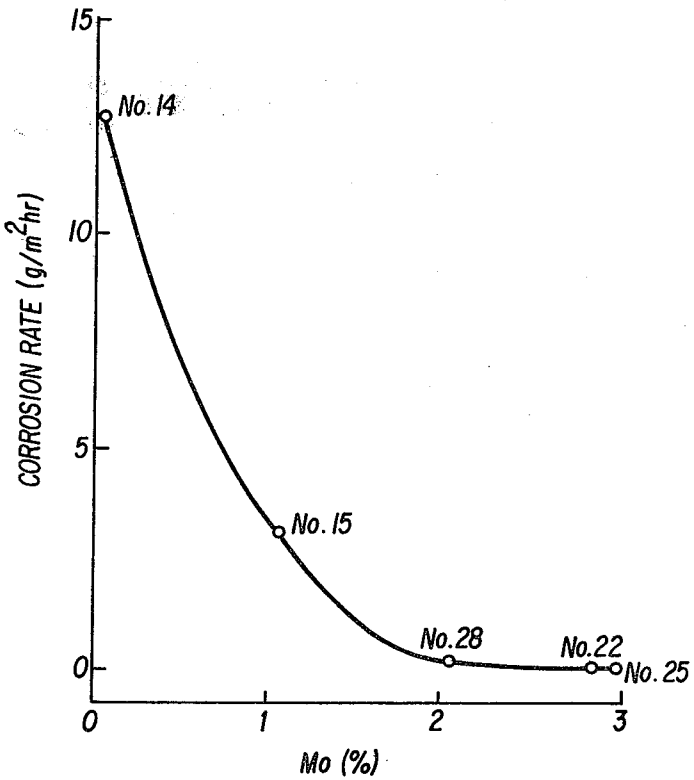
FIG. 4 is a graph showing the relation between Mo content and corrosion rate.

Mo is useful for increasing strength while improving resistance to chlorine (Cl) which has a close association with pitting corrosion, crevice corrosion and stress corrosion cracking. FIG. 4 is a graph showing the relation between Mo content (%) and pitting corrosion rate ($g/m^2.hr$) as observed in a test conducted on the steel samples with different Mo contents (basic composition: 0.01% C, 0.5% Si, 2.5% Mn, 25% Cr, 19% Ni, 0.25% N and various % Mo) by immersing each sample in a ferric chloride solution (5% $FeCl_3$+1/20 NHCl, liquid temp. 40° C.) for 48 hours. As seen from the graph, the corrosion rate decreases sharply with increase of the Mo content, and a marked pitting corrosion resistance is provided by addition of Mo in an amount of not less than 1.5%. Excess addition of Mo, however, impairs hot workability of the steel and also narrows the forgeable temperature range as noticed from the graph of FIG. 5, so that the recommended Mo content range is 1.5–5.5%, more preferably 2.0–4.0% for the maximum corrosion resistance and hot workability.

Figure 6:
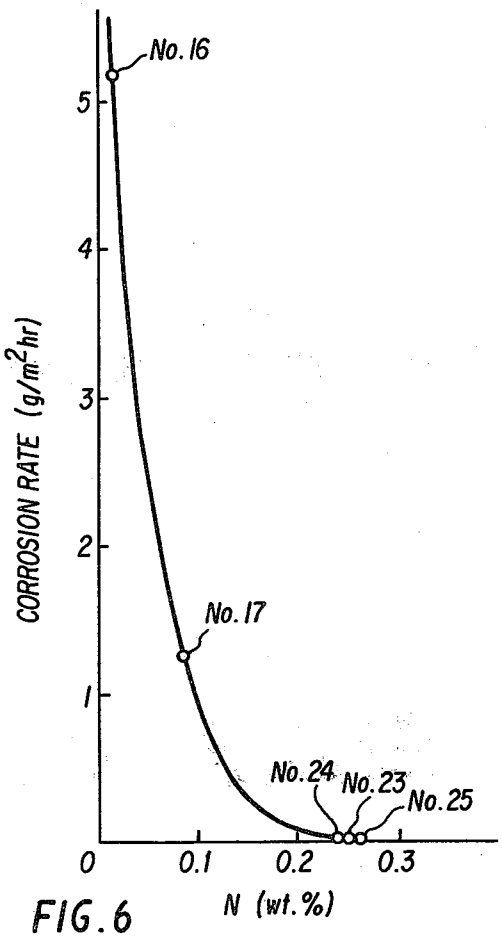
FIG. 6 is a graph showing the relation between N content and corrosion rate.

N is an element which can improve Cl resistance and steel strength. In the composition of this invention, the amount of C, which is a strength improving element, is confined to as small as up to 0.2% so as not to affect the corrosion resistance of the steel, so that no sufficient strength is provided with such C content. N is therefore an essential element for making up for such shortage of strength; a high strength of over 70 $kg/mm^2$ can be provided by adding a suitable amount of N. N is also an austenite forming element and proves helpful for homogenization of the steel structure and stabilization of corrosion resistance. FIG. 6 is a graph showing the relation between pitting corrosion rate ($g/m^2.hr$) and N content (%) as determined by testing the steel samples with different N contents (basic composition: 0.01% C, 0.5% Si, 2.5% Mn, 25% Cr, 19% Ni, 3% Mo and various % N) by immersing each sample in a ferric chloride solution (5% $FeCl_3$+1/20 NHCl, liquid temperature: 40° C.) for 48 hours. As admitted from the graph, the corrosion rate decreases as the N content increases, and addition of N in an amount of not less than 0.15% provides the maximum corrosion resistance as well as saliently enhanced strength. Excess addition of N, however, is quite impractical economically and also hampers hot workability of the product, so that the upper limit of N content is desirably given as 0.45%. Thus, the N content in the steel composition of this invention is defined to be within the range of 0.15–0.45%, more preferably 0.2–0.4% from the viewpoints of corrosion resistance and hot workability.

Figure 7:
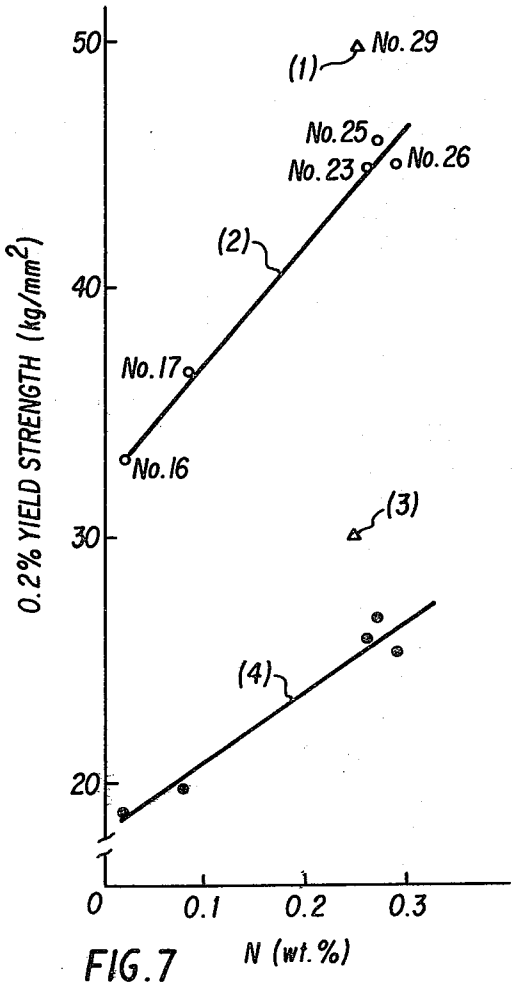
FIG. 7 is a graph showing the relation between Mn and N content and 0.2% yield strength.

Mn works effectively not only for increasing steel strength but also for stabilizing the structure as an austenite forming element like said Ni and N. It also produces a synergistic effect with N for further increasing the steel strength. FIG. 7 is a graph showing 0.2% yield strength as measured with the test samples having different Mn and N contents (basic composition: 0.01% C, 0.5% Si, 2.5 or 5.0% Mn, 25% Cr, 19% Ni, 3% Mo and 0.02–0.3% N) at room temperature and at an elevated temperature (316° C.). In the graph, (1) and (2) show the results obtained at room temperature, the former being a 5% Mn sample and the latter being a 2.5% Mn sample, and (3) and (4) show the results obtained at 316° C., the former being a 5% Mn sample and the latter being a 2.5% Mn sample. As appreciated from these results, yield strength can be markedly enhanced by increasing both N and Mn contents. Although excess addition of Mn is attended by operational difficulties, no impediment is caused and good mechanical properties are provided if it is added in an amount of up to 6.5%. However, no desired improvement of strength can be derived from Mn content of less than 2.0%. Hence, a range of 2.0–6.5% is recommended for the Mn content in the steel composition of this invention.

Si is used as deoxidizer at the time of steel making, but too much amount of Si invites ill effects such as high-temperature cracking during welding of steel, so that Si should be used in an amount of up to 0.7%.

In addition to the above-said elements, V may be further added if necessary. This element acts jointly with the abovesaid elements N, Mn and Mo to further increase the steel strength without affecting corrosion resistance. However, too much addition of V brings about disadvantages such as deterioration of weldability and hot workability as well as poor economy, so that it is added in an amount of not more than 0.6%, namely, 0–0.6% of V is added in this invention. Further it is more preferably added in an amount of not less than 0.1% for obtaining the maximum steel strength enhancing effect.

P and S are impurity elements and it is desirable that their contents in the steel are minimized, but the features of this invention are little affected if they are contained in an amount generally permitted to exist in the steels of the type contemplated, for example, up to 0.04% for P and up to 0.03% for S.

The characteristic properties of the steel according to this invention are now described in detail by citing an embodiment of the invention.

EXAMPLE

The test specimens with various chemical compositions were subjected to a comprehensive corrosion test while measuring the mechanical properties at room temperature and at elevated temperatures.

Table 1 shows the chemical compositions of the respective test specimens. In the table, Specimen Nos. 1–7 are the conventional steel samples, Specimen Nos. 8–21 are the comparative steel samples having the compositions resembling those of the steel according to this invention but outside the defined ranges of this invention, and Specimen Nos. 22–33 are the steel samples according to this invention. The conventional steel samples used in the test are as follows: Specimen No. 1 - JIS 304L, No. 2-316L, No. 3 - 304N, No. 4 - XM-19, No. 5 - 310N, No. 6-17-7 PH, and No. 7 - 17-4 PH.

Table 2 shows the testing conditions and the items of measurement in the respective corrosion tests. Two differently treated steel materials, that is, "solution heat treated material" and "sensitization treated material", were used for the intergranular corrosion test while the "solution heat treated material" alone was used for the other tests. The results are shown in Table 3.

Table 4 shows the mechanical properties of the solution heat treated samples at room temperature and at an elevated temperature (316° C.).

TABLE 1

| | Chemical compositions of the test specimens (wt %) | | | | | | | | | | |
|---|---|---|---|---|---|---|---|---|---|---|---|
| No. | C | Si | Mn | P | S | Ni | Cr | Mo | N | Others | Type |
| 1 | 0.021 | 0.63 | 1.11 | 0.023 | 0.005 | 10.09 | 18.39 | — | — | — | Conventional |
| 2 | 0.026 | 0.50 | 1.85 | 0.038 | 0.006 | 12.69 | 17.38 | 2.44 | — | — | " |
| 3 | 0.027 | 0.66 | 1.07 | 0.026 | 0.009 | 9.2 | 18.01 | — | 0.153 | — | " |
| 4 | 0.027 | 0.36 | 4.99 | 0.015 | 0.007 | 12.32 | 21.49 | 2.98 | 0.306 | V/0.21, Nb/0.23 | " |
| 5 | 0.007 | 0.46 | 1.98 | 0.006 | 0.011 | 22.40 | 24.75 | 2.12 | 0.136 | — | " |
| 6 | 0.062 | 0.51 | 0.37 | 0.012 | 0.004 | 7.06 | 17.11 | — | — | Al/1.13 | " |
| 7 | 0.041 | 0.50 | 0.23 | 0.009 | 0.004 | 4.51 | 16.28 | — | — | Nb/0.24, Cu/3.15 | " |
| 8 | 0.025 | 0.61 | 2.74 | 0.007 | 0.006 | 19.43 | 25.03 | 3.12 | 0.278 | — | Comparative |
| 9 | 0.041 | 0.58 | 2.54 | 0.007 | 0.005 | 19.26 | 25.21 | 3.13 | 0.271 | — | " |
| 10 | 0.013 | 0.42 | 2.11 | 0.006 | 0.005 | 19.11 | 20.24 | 3.01 | 0.248 | — | " |
| 11 | 0.012 | 0.43 | 2.53 | 0.008 | 0.005 | 19.13 | 22.68 | 3.01 | 0.253 | — | " |
| 12 | 0.011 | 0.51 | 2.72 | 0.008 | 0.004 | 10.19 | 25.00 | 3.00 | 0.258 | — | " |
| 13 | 0.013 | 0.51 | 2.81 | 0.007 | 0.005 | 14.08 | 25.32 | 3.15 | 0.257 | — | " |
| 14 | 0.015 | 0.63 | 2.81 | 0.009 | 0.004 | 19.36 | 25.46 | 0.12 | 0.247 | — | " |
| 15 | 0.014 | 0.48 | 2.76 | 0.011 | 0.003 | 19.71 | 25.13 | 1.08 | 0.286 | — | " |
| 16 | 0.011 | 0.47 | 2.75 | 0.010 | 0.005 | 18.97 | 25.27 | 3.01 | 0.015 | — | " |
| 17 | 0.011 | 0.47 | 2.55 | 0.010 | 0.005 | 19.01 | 25.41 | 2.97 | 0.085 | — | " |
| 18 | 0.009 | 0.45 | 2.72 | 0.009 | 0.004 | 17.01 | 25.33 | 2.91 | 0.254 | — | " |
| 19 | 0.011 | 0.41 | 2.50 | 0.011 | 0.003 | 19.17 | 25.03 | 6.13 | 0.299 | — | " |
| 20 | 0.011 | 0.47 | 2.73 | 0.011 | 0.003 | 19.61 | 24.93 | 3.03 | 0.263 | Nb: 0.41 | " |
| 21 | 0.012 | 0.55 | 2.58 | 0.009 | 0.005 | 19.67 | 25.36 | 2.98 | 0.274 | Nb: 0.21<br>V : 0.20 | " |
| 22 | 0.009 | 0.51 | 2.53 | 0.009 | 0.003 | 17.52 | 25.18 | 2.89 | 0.256 | — | This invention |
| 23 | 0.007 | 0.61 | 2.60 | 0.006 | 0.005 | 18.98 | 26.41 | 3.12 | 0.263 | — | This invention |
| 24 | 0.010 | 0.61 | 2.58 | 0.006 | 0.005 | 19.01 | 24.75 | 2.97 | 0.253 | — | This invention |
| 25 | 0.017 | 0.58 | 2.59 | 0.006 | 0.005 | 19.95 | 25.23 | 3.02 | 0.271 | — | This invention |
| 26 | 0.011 | 0.48 | 2.55 | 0.007 | 0.005 | 17.98 | 25.25 | 3.05 | 0.285 | — | This invention |
| 27 | 0.012 | 0.51 | 2.41 | 0.009 | 0.004 | 29.33 | 25.43 | 3.06 | 0.272 | — | This invention |
| 28 | 0.009 | 0.37 | 2.45 | 0.009 | 0.007 | 20.29 | 24.81 | 2.15 | 0.257 | — | This invention |
| 29 | 0.012 | 0.47 | 4.98 | 0.011 | 0.007 | 19.52 | 25.01 | 3.15 | 0.246 | — | This invention |
| 30 | 0.011 | 0.46 | 2.67 | 0.008 | 0.003 | 19.55 | 25.31 | 5.07 | 0.255 | — | This invention |
| 31 | 0.010 | 0.48 | 2.48 | 0.009 | 0.005 | 18.73 | 25.18 | 2.78 | 0.263 | V: 0.11 | This |

TABLE 1-continued

| Chemical compositions of the test specimens (wt %) | | | | | | | | | | | |
|---|---|---|---|---|---|---|---|---|---|---|---|
| No. | C | Si | Mn | P | S | Ni | Cr | Mo | N | Others | Type |
| 32 | 0.009 | 0.49 | 2.53 | 0.011 | 0.005 | 19.01 | 24.92 | 3.02 | 0.278 | V: 0.21 | This invention |
| 33 | 0.008 | 0.51 | 2.41 | 0.007 | 0.004 | 19.15 | 25.21 | 3.01 | 0.249 | V: 0.32 | This invention |

TABLE 2

| Corrosion testing conditions and items of measurement | | |
|---|---|---|
| Test Name | Conditions | Items of Examination |
| Hydrogen embrittlement | Hydrogen treatment<br>Atmospheric temp.: 450° C.<br>Atmospheric Pressure: 300 atm | Hydrogen embrittlement ratio (%) |
| Stress corrosion cracking | Testing solution: 3% NaCl<br>Temperature: 150° C.<br>Immersion time: 1 week<br>(V bend) | Presence or absence of cracks |
| Pitting corrosion | Testing solution: 5% $FeCl_3$ + 1/20 NHCl<br>Temperature: 40° C.<br>Immersion time: 48 Hr | Corrosion rate ($g/m^2 \cdot Hr$) |

TABLE 2-continued

| Corrosion testing conditions and items of measurement | | |
|---|---|---|
| Test Name | Conditions | Items of Examination |
| Crevice corrosion | Testing solution: 5% $FeCl_3$ + 1/20 NHCl<br>Temperature: 40° C.<br>Immersion time: 48 Hr | Corrosion rate ($g/m^2 \cdot Hr$) |
| General corrosion | Testing solution: 5% $H_2SO_4$<br>Temperature: (boiling)<br>Immersion time: 6 Hr | Corrosion rate ($g/m^2 \cdot Hr$) |
| Inter-granular corrosion | Testing solution: 65% $HNO_3$<br>Temperature: (boiling)<br>Immersion time: 48 Hr<br>(repeated five times) | Corrosion rate (ipm) |

TABLE 3

| Results of corrosion test | | | | | | | | |
|---|---|---|---|---|---|---|---|---|
| No. | Hydrogen embrittlement (%) | Stress corrosion cracking *1 | Pitting corrosion ($g/m^2 \cdot hr$) | Crevice corrosion ($g/m^2 \cdot hr$) | General corrosion ($g/m^2 \cdot hr$) | Intergranular corrosion *2 ($\times 10^{-5}$ ipm) A | B | Type |
| 1 | 80 | X | 29.6 | 30.0 | 331 | 83 | — | Conventional |
| 2 | 30 | X | 7.3 | 10.2 | 5.0 | 159 | — | " |
| 3 | 90 | X | 21.7 | 27.3 | 290 | 85 | — | " |
| 4 | 30 | X | 6.8 | 9.9 | 5.2 | 147 | — | " |
| 5 | 5 | ○ | 0.5 | 4.7 | 1.6 | 25 | — | " |
| 6 | 90 | X | 30.3 | 32.6 | 251 | 102 | — | " |
| 7 | 100 | ○ | 35.2 | 40.8 | 365 | 121 | — | " |
| 8 | 5 | ○ | 0 | 1.3 | 1.2 | 38 | 59 | Comparative |
| 9 | 5 | ○ | 0 | 1.4 | 1.1 | 66 | 160 | " |
| 10 | 5 | ○ | 0.8 | 2.3 | 1.5 | 42 | — | " |
| 11 | 5 | ○ | 0.6 | 2.2 | 1.1 | 30 | — | " |
| 12 | 80 | X | 0.6 | 1.9 | 4.7 | 24 | — | " |
| 13 | 20 | X | 0.6 | 1.9 | 3.6 | 25 | — | " |
| 14 | 5 | ○ | 12.7 | 20.4 | 38.5 | 23 | — | " |
| 15 | 5 | ○ | 3.1 | 5.5 | 3.2 | 25 | — | " |
| 16 | 5 | ○ | 5.2 | 7.2 | 1.3 | 24 | — | " |
| 17 | 5 | ○ | 1.5 | 2.6 | 1.1 | 25 | — | " |
| 18 | 7 | ○ | 0.4 | 0.7 | 1.8 | 25 | — | " |
| 19 | 5 | ○ | 0 | 0.3 | 0.5 | 41 | — | " |
| 20 | 30 | ○ | 0.1 | 1.3 | 1.2 | 24 | — | " |
| 21 | 23 | ○ | 0.3 | 1.0 | 1.3 | 25 | — | " |
| 22 | <5 | ○ | 0.1 | 0.6 | 1.0 | 25 | — | This invention |
| 23 | <5 | ○ | 0 | 1.0 | 1.1 | 24 | 24 | This invention |
| 24 | <5 | ○ | 0 | 0.8 | 0.9 | 25 | 25 | This invention |
| 25 | <5 | ○ | 0 | 0.7 | 1.3 | 25 | 25 | This invention |
| 26 | <5 | ○ | 0 | 1.0 | 1.4 | 26 | — | This invention |
| 27 | <5 | ○ | 0 | 0.7 | 1.2 | 25 | — | This invention |
| 28 | <5 | ○ | 0.1 | 1.4 | 2.1 | 24 | — | This invention |
| 29 | <5 | ○ | 0.3 | 1.5 | 2.0 | 26 | — | This invention |
| 30 | <5 | ○ | 0 | 0 | 0.2 | 35 | — | This invention |
| 31 | <5 | ○ | 0 | 0.8 | 1.8 | 25 | — | This invention |
| 32 | <5 | ○ | 0 | 0.9 | 1.5 | 27 | — | This invention |
| 33 | <5 | ○ | 0 | 1.2 | 1.1 | 26 | — | This |

TABLE 3-continued

| No. | Hydrogen embrittlement (%) | Stress corrosion cracking *1 | Pitting corrosion ($g/m^2 \cdot hr$) | Crevice corrosion ($g/m^2 \cdot hr$) | General corrosion ($g/m^2 \cdot hr$) | Intergranular corrosion *2 ($\times 10^{-5}$ ipm) A | B | Type |
|---|---|---|---|---|---|---|---|---|
| | Results of corrosion test | | | | | | | |
| | | | | | | | | invention |

*1 ○ denotes no cracking, and X denotes cracking.
*2 A denotes a solution heat treated material, B denotes a sensitization treated material.

TABLE 4

| | Mechanical Properties: Room temperature 0.02% yield strength ($kg/mm^2$) | Room temperature Tensile strength ($kg/mm^2$) | Room temperature Elongation (%) | High temperature (316° C.) 0.2% yield strength ($kg/mm^2$) | High temperature Tensile strength ($kg/mm^2$) | High temperature Elongation (%) | Classification of samples |
|---|---|---|---|---|---|---|---|
| 1 | 28.0 | 59.2 | 59 | 16.4 | 42.5 | 43 | Conventional |
| 2 | 28.1 | 58.6 | 57 | 17.2 | 43.1 | 41 | " |
| 3 | 37.2 | 71.6 | 53 | 22.1 | 56.0 | 46 | " |
| 4 | 49.8 | 87.3 | 44 | 30.0 | 67.9 | 39 | " |
| 5 | 37.1 | 69.4 | 49 | 20.6 | 51.3 | 44 | " |
| 6 | 27.9 | 90.8 | 35 | 15.3 | 70.8 | 45 | " |
| 7 | 77.5 | 104.8 | 12 | 57.6 | 86.1 | 15 | " |
| 8 | 45.9 | 83.8 | 49 | 26.5 | 64.8 | 46 | Comparative |
| 9 | 46.8 | 85.2 | 47 | 27.0 | 65.9 | 46 | " |
| 10 | 41.2 | 75.8 | 51 | 24.0 | 59.2 | 47 | " |
| 11 | 42.8 | 78.8 | 50 | 25.1 | 61.8 | 47 | " |
| 12 | 43.4 | 82.3 | 41 | 22.6 | 63.2 | 39 | " |
| 13 | 43.2 | 80.9 | 46 | 23.8 | 62.7 | 41 | " |
| 14 | 40.3 | 76.6 | 49 | 23.3 | 59.2 | 43 | " |
| 15 | 42.6 | 78.5 | 47 | 24.8 | 60.8 | 42 | " |
| 16 | 33.2 | 63.3 | 43 | 18.9 | 48.8 | 38 | " |
| 17 | 36.7 | 68.4 | 46 | 19.8 | 52.6 | 40 | " |
| 18 | 48.6 | 87.5 | 45 | 29.0 | 68.2 | 42 | " |
| 19 | 50.2 | 88.6 | 40 | 28.2 | 67.3 | 35 | " |
| 20 | 52.3 | 88.9 | 30 | 32.3 | 71.2 | 30 | " |
| 21 | 54.2 | 89.0 | 30 | 30.1 | 70.7 | 28 | " |
| 22 | 46.7 | 84.1 | 48 | 26.5 | 64.3 | 45 | This invention |
| 23 | 44.9 | 81.9 | 50 | 25.8 | 63.7 | 47 | This invention |
| 24 | 45.3 | 82.7 | 50 | 26.3 | 64.1 | 46 | This invention |
| 25 | 46.2 | 83.3 | 50 | 26.7 | 64.2 | 46 | This invention |
| 26 | 45.0 | 82.1 | 49 | 25.3 | 63.4 | 46 | This invention |
| 27 | 42.1 | 78.2 | 50 | 24.7 | 60.0 | 48 | This invention |
| 28 | 43.7 | 79.9 | 52 | 25.2 | 62.8 | 48 | This invention |
| 29 | 50.1 | 87.4 | 45 | 29.9 | 68.4 | 40 | This invention |
| 30 | 45.9 | 83.2 | 48 | 27.3 | 66.1 | 42 | This invention |
| 31 | 46.2 | 83.3 | 48 | 27.1 | 65.6 | 45 | This invention |
| 32 | 47.6 | 86.1 | 45 | 28.2 | 67.3 | 38 | This invention |
| 33 | 51.2 | 88.3 | 44 | 29.6 | 68.2 | 40 | This invention |

Concerning the corrosion resistance of the test specimens, the conventional samples (Specimen Nos. 1–7) are evidently inferior in hydrogen embrittlement resistance and other forms of corrosion resistance. The aging treatment on these steel samples can not provide the desired improvement and may, in some cases, rather worsen said resistance. Among these conventional steel samples, No. 4 showed a relatively good result but it was still poor in crevice corrosion resistance. The comparative samples (Specimen Nos. 8–21) were generally better in quality than the said conventional ones, but they have both merits and demerits concerning resistance to the respective types of corrosion and are not satisfactory when considered as a whole. On the other hand, the steel samples of this invention (Specimen Nos. 22–33) showed good properties better than said conventional and comparative samples in resistance to hydrogen embrittlement, stress corrosion cracking, pitting corrosion, crevice corrosion and general corrosion, and it was thus ascertained that the steel materials of this invention are highly resistant to all sorts of corrosion.

As for the mechanical properties, the steel materials of this invention (Specimen Nos. 22–33) have higher strength than the conventional and comparative steels both at room temperature and at elevated temperatures as shown in Table 4. Such high strength is mostly attributable to the synergistic effect of Mn, Mo and N, but it is further enhanced by addition of V (Specimen Nos. 31, 32 and 33). It will be also noted that the steel samples of this invention, while provided with high strength as viewed above, also have high elongation and excellent workability.

Heretofore, V and Nb have been treated equally as carbon stabilizing elements, but the following facts were unveiled in the course of the study by the present inventors. Here is therefore mentioned the effect of V and Nb on the mechanical properties and hydrogen embrittlement resistance of steel.

Figure 8:
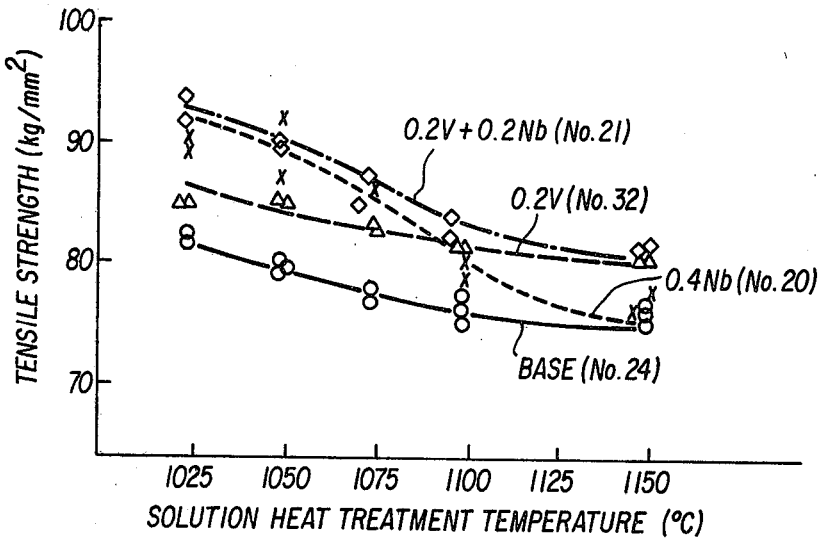
FIG. 8 is a graph showing the mechanical properties of V and/or Nb incorporated steel samples.
Figure 9:
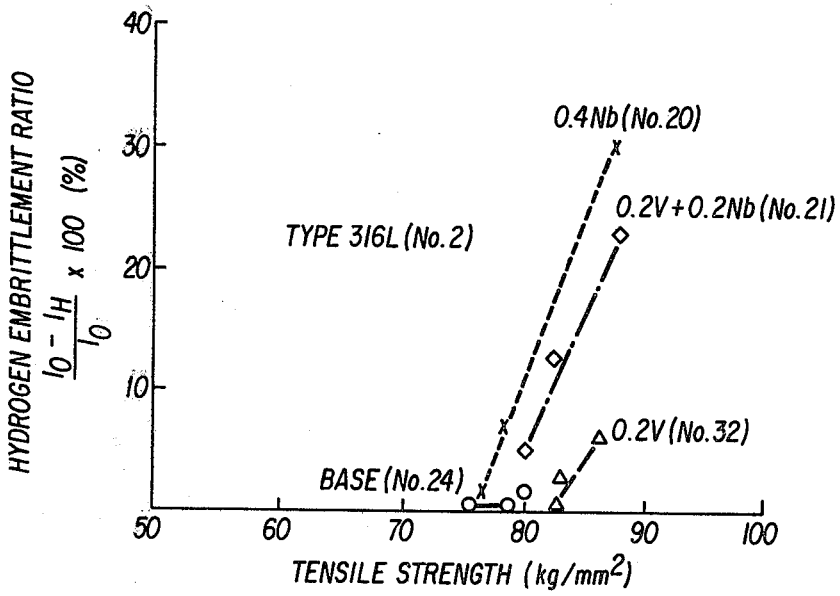
FIG. 9 is a graph showing the hydrogen embrittlement ratio of V and/or Nb incorporated steel samples.

As seen from FIG. 8, addition of V brings about a stabilized strength improving effect, but the effect of addition of Nb depends greatly on the solution heat treatment temperature, and as noted, little effect is provided and strength is very unstable at high temperatures. On the other hand, as apparent from FIG. 9, addition of V scarcely promotes hydrogen embrittlement whereas addition of Nb accelerates hydrogen embrittlement excessively as compared with V. It was thus certified that V, unlike Nb, is an effective element for raising steel strength without affecting hydrogen embrittlement resistance.

As viewed above, the steel according to this invention not only shows excellent corrosion resistance and, in particular, hydrogen embrittlement resistance in various corrosive environments but also has excellent mechanical properties, so that it will provide an ideal material for the high-temperature and high-pressure reaction vessels and other apparatuses used in the fields of chemical industry where various kinds of chemicals are treated under the high-temperature and/or high-pressure conditions. Also, because of its high Cl resistance, it will find a variety of uses in the fields using sea water where Cl resistance is a matter of serious concern.

What is claimed as new and intended to be covered by Letters Patent is:

1. A high strength austenitic stainless steel having good corrosion resistance and, in particular, good hydrogen embrittlement resistance, consisting essentially of:

| | |
|---|---|
| carbon | up to 0.02% by weight |
| silicon | up to 0.7% by weight |
| manganese | about 2.4 to 6.5% by weight |
| nickel | 17.5 to 30.0% by weight |
| chromium | 23.0 to 35.0% by weight |
| molybdenum | 1.5 to 5.5% by weight |
| nitrogen | 0.15 to 0.45% by weight |
| vanadium | 0 to 0.6% by weight |

the balance iron and inevitable impurities.

2. The austenitic stainless steel as set forth in claim 1, wherein the nickel content is 17.5 to 23.0% by weight.

3. The austenitic stainless steel as set forth in claim 1, wherein the chromium content is 24.0 to 27.0% by weight.

4. The austenitic stainless steel as set forth in claim 1, wherein the molybdenum content is 2.0 to 4.0% by weight.

5. The austenitic stainless steel as set forth in claim 1, wherein the nitrogen content is 0.2 to 0.4% by weight.

6. The austenitic stainless steel as set forth in claim 1, wherein the vanadium content is 0.1 to 0.6% by weight.

* * * * *